US005333670A

United States Patent [19]

Brandy et al.

[11] Patent Number: 5,333,670

[45] Date of Patent: Aug. 2, 1994

[54] VITREOUS FUSED SILICA

[75] Inventors: Gilbert Brandy, Feignies; Jean-Claude Compagnon, Hautmont; Jean-Marie Vignot, Mairieux, all of France

[73] Assignee: Vesuvius Crucible Company, Pittsburgh, Pa.

[21] Appl. No.: 45,014

[22] Filed: Apr. 7, 1993

Related U.S. Application Data

[63] Continuation-in-part of Ser. No. 671,723, Mar. 28, 1991, abandoned.

[30] Foreign Application Priority Data

Sep. 30, 1988 [FR] France ..... 88 12832

[51] Int. Cl.[5] ..... B22C 1/02; C04B 35/14

[52] U.S. Cl. ..... 164/364; 164/529; 164/23

[58] Field of Search ..... 164/23, 27, 137, 122, 164/364, 529

[56] References Cited

U.S. PATENT DOCUMENTS 4,583,581 4/1986 Ferguson et al. ..... 164/529
4,951,852 8/1990 Rancoule ..... 427/443.2

FOREIGN PATENT DOCUMENTS 0012040 6/1980 European Pat. Off. .
1341233 12/1973 United Kingdom .
1549819 8/1979 United Kingdom .

*Primary Examiner*—Kuang Y. Lin
*Attorney, Agent, or Firm*—Webb Ziesenheim Bruening Logsdon Orkin & Hanson

[57] ABSTRACT

The invention concerns a new material for molding elements as well as the molds produced in this manner. This material contains more than 30% vitreous fused silica and various adjuvants and binders and presents the advantage of the possibility of modulating the thermal conductivity of the molds. Application to all types of industries utilizing shaping by molding of liquid or paste-like materials, or by the hot deformation of flat products.

5 Claims, 3 Drawing Sheets

VITREOUS FUSED SILICA

CROSS-REFERENCE TO RELATED APPLICATIONS

This is a continuation-in-part application of co-pending applications U.S. Ser. No. 07/671,723, filed Mar. 28, 1991, now abandoned, and International Application PCT/EP89/01136, filed Sep. 28, 1989 and which designated the United States.

BACKGROUND OF THE INVENTION

The present invention relates generally to foundry molds for use in casting metal shapes.

It is an object of the present invention to provide a new composition that is particularly well adapted to the fabrication of molding elements. A more particular object of the invention is to provide a material for molds comprising selected amounts of vitreous fused silica.

At the present time, foundry casting commonly utilizes metal molds, generally of an all metal, unitary construction. The use of most metals presents numerous disadvantages.

The very high thermal conductivity of these prior metal molds is probably the biggest disadvantage. In addition, the chemical elements in the metal molds present the risk of migrating in the cast piece during molding; this is notably due to the difference in chemical potential that can exist between the mold and the material to be shaped.

Some of these problems are solved by the use of a lubricant or release agent, in which a coating is applied inside the metal molds. However, due to the stresses exerted on the walls of the mold, this release agent does not solve the above problems in a permanent manner and is only a temporary measure. In addition, applying a lubricant or release agent is a time consuming operation that immobilizes the molds. This necessitates having at least two sets of molds, one having the lubricant applied while the other is in service. Furthermore, the whole set of equipment is immobilized when one set of molds is replaced with another. In this latter case, a loss of productivity on the order of 10%-20% is relatively common.

Among the various problems that remain unresolved, those induced by the excessively high thermal conductivity of the molds are the most important. In particular, the fact that there are zones of variable thickness in the piece to be molded leads to difficulties in filling the mold, with the narrowest parts cooling much more rapidly. In order to remedy these difficulties, one is generally forced to (1) provide a substantial volume in the feeder heads, which serve as a reserve for the piece to be molded and (2) to heat the molds before and frequently during production and (3) to increase the temperature of the molten metal material feeding the mold.

All these remedying measures are very costly in both money and energy.

Accordingly, one object of the present invention is to provide a material that can be used for the molds, but does not chemically react with the materials to be shaped.

Another object of the present invention is to provide a mold material whose thermal conductivity can be selectively controlled.

Another object of the present invention is to provide a material of the above type that does not require a release agent.

Another object, finally, is to provide molds or parts of molds produced of this material.

SUMMARY OF THE INVENTION

These and other objects and advantages that will appear in the following are achieved by means of a material for molding elements, characterized by the fact that it contains vitreous fused silica in an amount at least equal to 30%, preferably at least about 50%, and more preferably, between 70%-100% by weight.

In effect, during the studies that led to the present invention, it was demonstrated that, contrary to the teachings of the prior art, it was possible by optimizing the operating conditions to obtain cast pieces for which the ratio between maximum thickness and minimum thickness was high.

It was also demonstrated that during the production of the molding elements and their utilization, the loading agents and the adjuvants diffuse too little into the vitreous fused silica to modify the properties.

It was demonstrated that a broad range of various materials constituting the charge and/or the binder could be chosen.

With regard to the charge, it can be chosen in the various classic adjuvants: refractory earths, metal oxides, or compounds of oxides, metal borides, metal carbides, metal nitrides, neoceramics, vitreous fused silica and silica compounds. Among the metal oxides, it is the refractory oxides and oxide compounds that are involved, more particularly, the oxides of transition metals and elements of columns 3 and 4*a* of the periodic table of elements.

The most suitable carbides are silicon, titanium and tungsten carbides, the most suitable nitrides are titanium, tungsten, boron and silicon nitrides, the sialons and oxynitrides of silicon; the most suitable borides are titanium borides. The neoceramics that can be cited are those obtained by the thermal decomposition of carbosilanes.

One of the advantages of the present invention is the ability to modulate the thermal conductivity by regulating the amount and composition of the refractory charge. The thermal conductivity of the mold elements can thus be selectively varied between a value of about ½ W/m°C. and about 10 W/m°C. In using these materials it was necessary to develop various compositions and various procedures, especially when the ratio of maximum to minimum thickness of the piece to be shaped is greater than about 1.5. The techniques used readily make it possible to achieve the production of pieces whose thickness ratios attain about 6, 7 and even 10. The technique applied utilizes a mixture containing 2%-20% water by weight. This mixture is composed of a slip of vitreous fused silica, granular vitreous silica, the adjuvant charge and possibly a binder. The said slip also contains viscosity agents for bringing the viscosity of the mixture to a value between 0.1 and about 50 Pa.s.

As known in the art, the shaping technique to be employed in making a mold element will affect the selection of the viscosity and the water content of the said slip and, to a lesser degree, the granulometry of the vitreous fused silica. The granulometry and viscosity should be chosen so that the sedimentation rate of an average particle is less than about 200 mm/h, preferably about 100 mm/h. When a casting technique is used, a reservoir should be provided for the mold to compensate for the shrinkage, which is generally about 10% by volume. A slip having on the order of 16%-20% water is preferably used for this casting technique. This mixture is cast into a mold of plaster of Paris according to techniques that are well-known in the foundry art. During drying in the plaster mold, the shrinkage is compensated by the mixture reserve contained in the reservoir.

For other techniques, i.e., pressing, injection, vibro-compacting or vibro-casting, mixtures having a high viscosity of the order of 1-20 Pa.s, preferably in the vicinity of 10 Pa.s, are used.

Mixtures having a much lower percentage of water are used in these cases also, since they generally contain only about 2%-10% water by weight.

Once the mixture is shaped, cohesion of the piece is obtained by natural aging, drying, polymerization or baking. These means can be used separately or in combination.

In some very difficult cases, modification of the shape of the pieces and improvement of the surface state can be envisioned after cohesion is obtained. The dimensional tolerance in this case is of the order of 1/10 millimeter. Diamond and/or carbide tools should preferably be used for this, e.g., milling cutters about 2-10 mm in diameter, having a cutting speed greater than 250 m/min and having an advance rate in the vicinity of 10-100 mm/min; the quantities removed are of the order of 100 $mm^3$/min.

The pieces thus obtained could form mold parts or mold elements that could constitute the mold in its entirety, e.g., when assembled in a cradle.

Each mold element could have its own thermal conductivity, thus permitting substantial gains in productivity and a significant reduction in the feeder heads.

DETAILED DESCRIPTION OF THE INVENTION

In the present description, the terms "about", "in the vicinity of" and "of the order of" stress that the numerical figures given correspond to mathematical rounding off and that the zeroes do not constitute significant figures, but simply correspond to arithmetic of position.

The following nonlimiting example will enable those skilled in the art to implement the present invention and better understand its objects and advantages.

EXAMPLE

A piston mold was made by using the techniques of the present invention. By way of example, tests conducted on the casting of pistons made it possible to reduce the feeder head by an amount equal to 102 g for a gross piece weight of 453 g.

Figure 1:
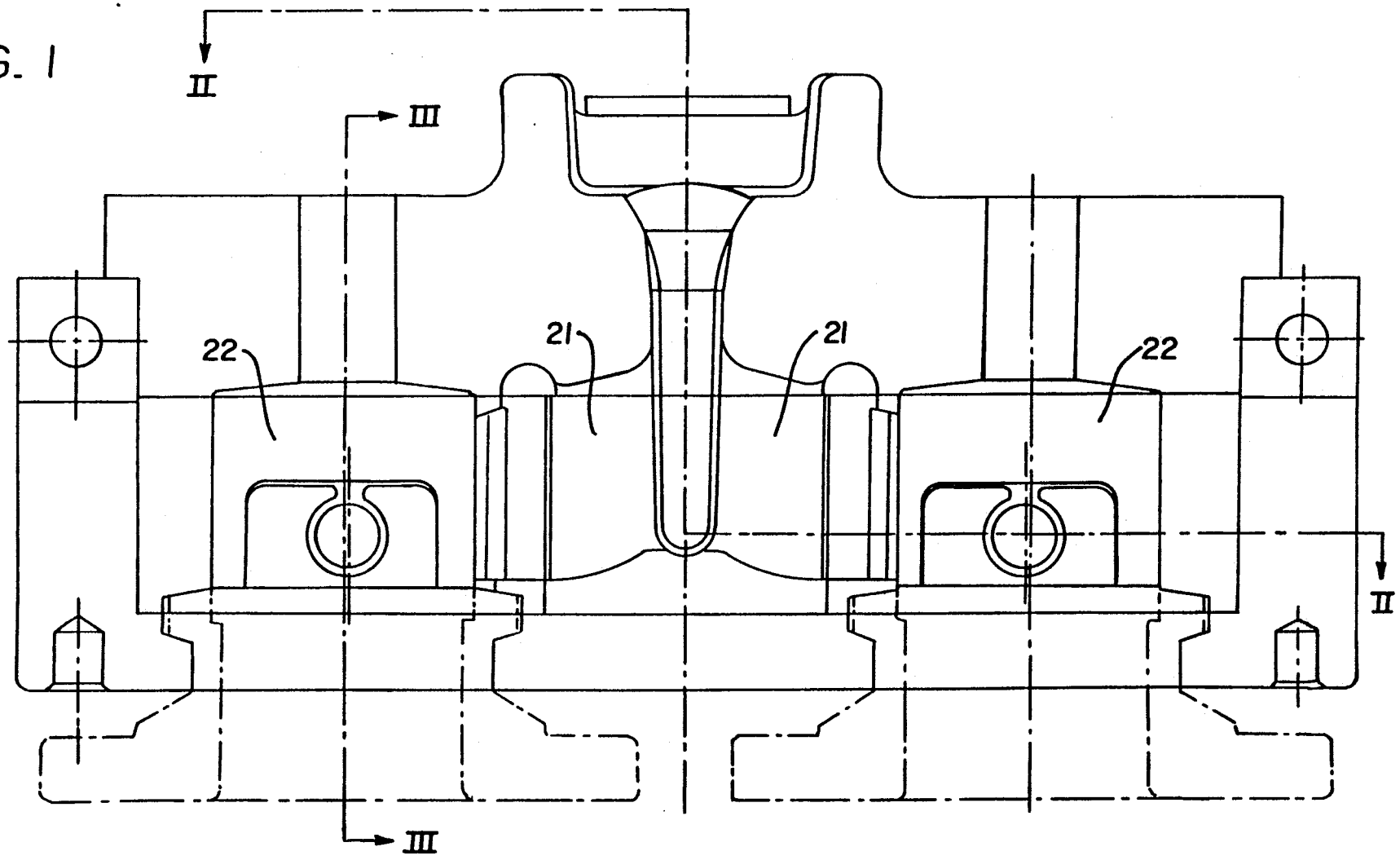
FIG. 1 shows a half-mold, front view, from the side of its inner face.
Figure 2:
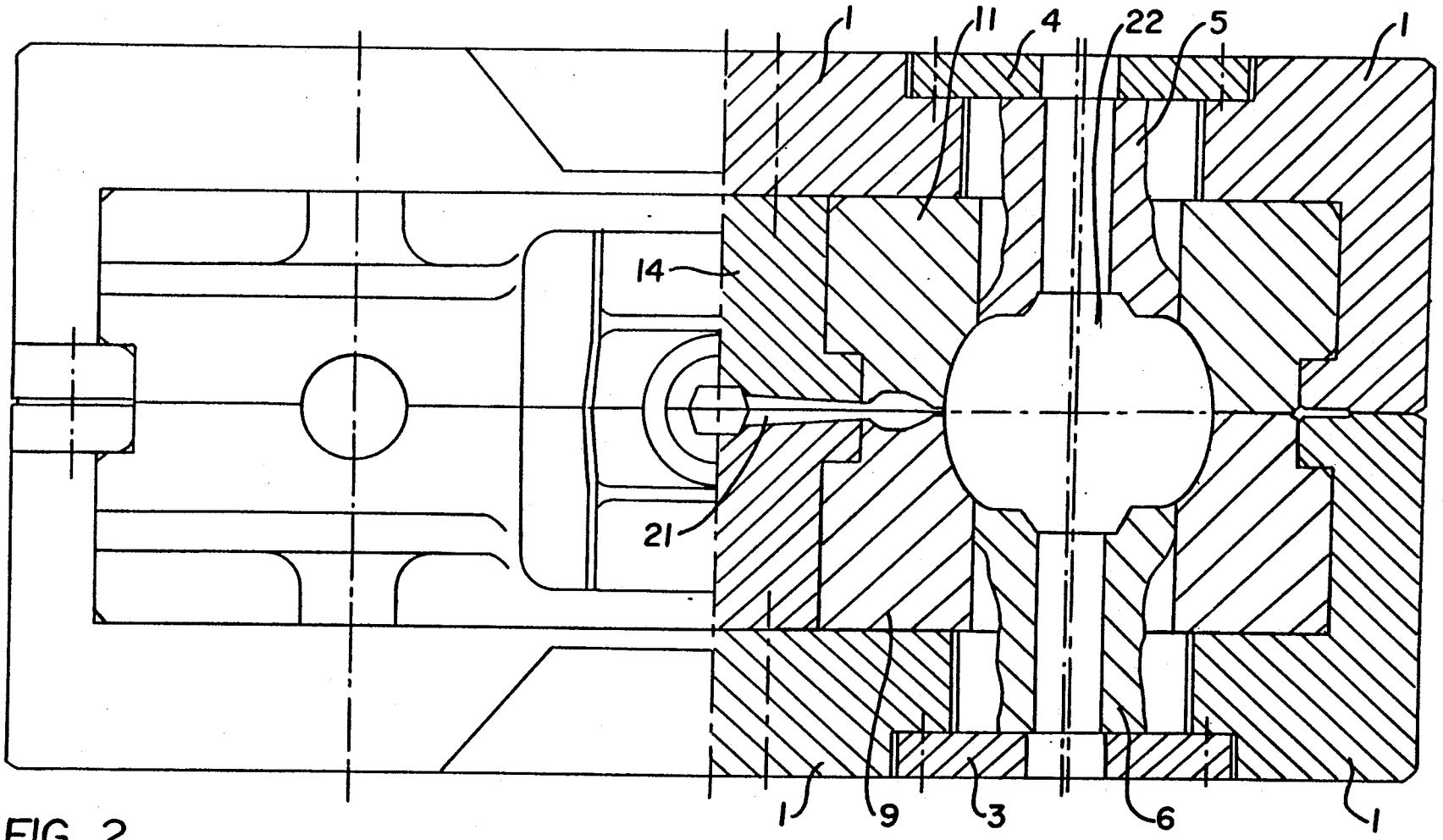
FIG. 2 shows a section along line II—II of the complete mold as shown in FIG. 1.
Figure 3:
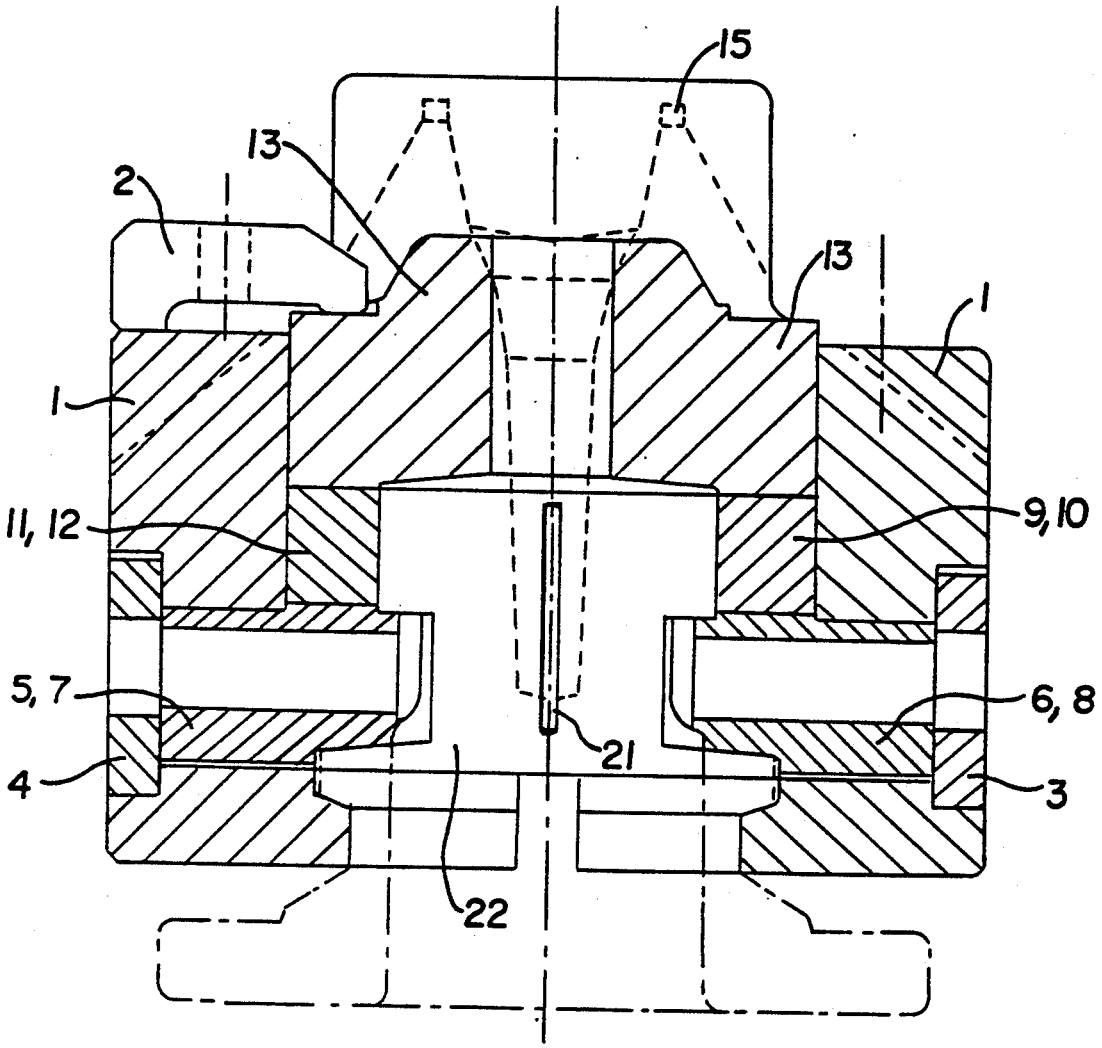
FIG. 3 is a cross section along line III—III of the mold of FIG. 1.

The mold elements are produced by using a mixture with 18% water, comprising a slip effected with a vitreous fused silica, wherein 80% of the particles have a diameter $\leqq 1$ μm and with a charge composed of vitreous silica with a granulometry $\leqq 300$ μm and possibly supplemented with silicon carbide and one or more of the other adjuvants described above in plaster of Paris molds. Once the piece is dry, it is progressively brought to 850° C., the temperature raising operation lasting four days: the piece is held at 850° C. for 24 hours. The molding element is progressively returned to ambient temperature, the operation lasting 24 hours. The elements are assembled as indicated in FIG. 1, 2 and 3.

The shape of the molding elements and their assembly are known in themselves and are not the object of the present invention.

The vitreous fused silica used is that sold under the trademark Glasrock, the characteristics of which are given in the following Table I.

TABLE I

| GENERAL CHARACTERISTICS | |
|---|---|
| Chemical analysis: $SiO_2$ | 99.5% |
| Mineralogical composition | 2% |
| Crystalline phases | |
| Physical properties | |
| Density | 1.9 Kg · $dm^{-3}$ |
| Open porosity | 12% |
| Coefficient of expansion | 0.6 $10^{-6}$ °C.$^{-1}$ |
| Modulus of rupture by bending | 12 N · $mm^{-2}$ |
| Thermal conductivity | |
| 260° C. | 0.36 Kcal · $h^{-1}$ · $m^{-1}$ · °C.$^{-1}$ |
| 540° C. | 0.51 |
| 824° C. | 0.64 |
| 1090° C. | 0.88 |

The mold assembly shown in the drawings represents one presently preferred embodiment of the invention wherein a pair of pistons for an internal combustion engine are cast. The mold assembly comprises a plurality of mold elements 5-13 of specially shaped surfaces which define and form the piston head shape 22 when molten metal is poured therein via gate 21. The mold elements directly in contact with the molten metal are made from the vitreous fused silica containing material of the invention and possess preselected thermal conductivity properties depending upon the desired amount of heat to be evacuated from particular sections of the casting.

With reference to the drawings, it will be appreciated that the outer mold elements are made from steel while the inner elements which contact the molten metal are made from a refractory ceramic containing at least 30% by weight fused silica material. More specifically, the mold contains outer support blocks 1, clamping collar 2, support plates 3, 4 and lower feed blocks 14 made from steel. The attached mold elements 5, 6, 7 and 8 of the left hand and right hand mold case are made from 100% fused silica material having a coefficient of thermal conductivity of 0.6 W/m°C., which is obviously quite low. Diluted refractory mixtures containing fused silica will have a higher coefficient of thermal conductivity of up to 10 W/m°C. as set forth above.

Left and right hand mold elements 9, 10, 11 and 12 surrounding the mid portion of the piston head 22 are made from a refractory composition containing 70% fused silica, FIG. 3. The upper mold element 13 forms a portion of the upper surface of the piston head and is made from 100% fused silica refractory material. Hence, the mold of the present invention is made up of elements comprising steel, 100% fused silica and diluted fused silica refractory compositions, each possessing a desired thermal conductivity depending upon the quantity of heat to be evacuated from the casting at each selected location. It will be observed by those skilled in the art that the thermal conductivity of the mold elements will be lower in locations where the cross section of the casting is thin. Conversely, in thick sections, the thermal conductivity of the mold elements is made selectively higher so as to evacuate the heat more rapidly and solidify the metal in such thick sections. Thus, by selectively providing the lowest thermal conductivity in the mold elements forming the thin cross sections, the metal more easily fills these thin cross sections since less heat is extracted therefrom. Conversely, a greater amount of heat is extracted in the thicker cross sections by virtue of the higher thermal conductivity of those mold elements.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A mold for use in casting metal shapes comprising a plurality of mold elements for defining the contour of the cast shape, each of said mold elements made from a refractory composition including at least 30% by weight up to 100% by weight vitreous fused silica to obtain a selected coefficient of thermal conductivity in each said mold elements of between about 0.5 and about 10 W/m°C., and wherein selected mold elements adjacent a portion of said cast shape having a first, thinner cross section are of a refractory composition having a lower selected coefficient of thermal conductivity than that of other selected mold elements adjacent portions of said cast shape having a second, heavier cross section whereby heat is extracted from said casting during solidification in a selected manner.

2. The mold of claim 1 wherein the refractory composition of the mold elements consists essentially of at least 70% by weight vitreous fused silica and the balance of at least one adjuvant chosen from the group consisting of refractory earths, metal oxides and compounds of oxides, carbides, borides, nitrides and oxynitrides of silicon, sialons and thermal decomposition products of carbosilanes.

3. The mold of claim 1 wherein the refractory composition of said selected mold elements adjacent the portion of said cast shape having said first, thinner cross-section consists essentially of 100% by weight vitreous fused silica.

4. The mold of claim 1 wherein the cast metal shapes are piston heads for internal combustion engines.

5. The mold of claim 1 wherein the mold elements are made from a slurry, wherein at least 80% of the vitreous fused silica in said slurry has a particle size less than or equal to 1 micron.

* * * * *